US008071928B2

(12) United States Patent
Geswender et al.

(10) Patent No.: US 8,071,928 B2
(45) Date of Patent: Dec. 6, 2011

(54) PROJECTILE WITH FILLER MATERIAL BETWEEN FINS AND FUSELAGE

(75) Inventors: Chris E. Geswender, Green Valley, AZ (US); Shawn B. Harline, Tucson, AZ (US); Nicholas E. Kosinski, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 503 days.

(21) Appl. No.: 12/257,699

(22) Filed: Oct. 24, 2008

(65) Prior Publication Data

US 2010/0102162 A1 Apr. 29, 2010

(51) Int. Cl.
*F42B 15/01* (2006.01)

(52) U.S. Cl. ..... 244/3.29

(58) Field of Classification Search ..... 244/3.1, 244/3.23, 3.24, 3.27–3.29, 3.3, 3.25, 3.26
See application file for complete search history.

(56) References Cited

U.S. PATENT DOCUMENTS

| | | | | |
|---|---|---|---|---|
| 4,460,137 | A | 7/1984 | Andersson et al. | |
| 4,546,940 | A | 10/1985 | Andersson et al. | |
| 4,817,891 | A * | 4/1989 | Gaywood | 244/3.23 |
| 5,211,358 | A * | 5/1993 | Bagley | 244/3.27 |
| 6,571,715 | B1 * | 6/2003 | Bennett et al. | 102/439 |
| 6,588,700 | B2 * | 7/2003 | Moore et al. | 244/3.28 |
| 6,869,044 | B2 * | 3/2005 | Geswender et al. | 244/3.29 |
| 6,978,967 | B1 | 12/2005 | Scheper et al. | |
| 7,728,266 | B2 * | 6/2010 | Melkers et al. | 244/3.27 |
| 7,829,829 | B2 * | 11/2010 | King et al. | 244/3.25 |

FOREIGN PATENT DOCUMENTS

| | | |
|---|---|---|
| GB | 1352118 | 5/1974 |
| GB | 2274904 | 8/1994 |

OTHER PUBLICATIONS

Amended claims from U.S. Appl. No. 12/257,690.
International Search Report and Written Opinion from corresponding International Application No. PCT/US09/51802.

* cited by examiner

*Primary Examiner* — Richard Price, Jr.
(74) *Attorney, Agent, or Firm* — Renner, Otto, Boisselle & Sklar, LLP

(57) ABSTRACT

A projectile has filler material placed between an outer surface of its fuselage, and fins that are hingedly coupled to the fuselage. The filler material fills space that otherwise would be occupied by pressurized gases. Such pressurized gases could cause undesired outward force against the projectile fins during launch of the projectile from a launch tube or gun, such as when pressure outside the fins is suddenly removed, as in when the projectile passes a muzzle brake in the launch tube. The filler material may be any of a variety of lightweight solid materials, such as suitable plastics or closed cell foams. The filler material prevents pressurized gases from entering at least some of the space between the fins and the outer fuselage surface. When the fins deploy after the projectile emerges from the launch tube the filler material pieces fall away harmlessly.

25 Claims, 3 Drawing Sheets

PROJECTILE WITH FILLER MATERIAL BETWEEN FINS AND FUSELAGE

BACKGROUND OF THE INVENTION

1. Field of the Invention

The invention is in the field of projectiles launched form launch tubes or guns.

2. Description of the Related Art

Launching a projectile from a launch tube or gun requires as a practical matter that the projectile fit into a circular cross section tube. This makes it difficult to provide the projectile with fins, for example to stabilize the flight of the projectile. Many solutions have been tried to accommodate finned projectiles in guns or launch tubes, but no solution has been completely effective.

SUMMARY OF THE INVENTION

According to an aspect of the invention, filler material is placed between fins of a projectile and a fuselage of the projectile.

According to another aspect of the invention, a method of configuring a projectile includes molding filler material between the fins of the projectile, and a fuselage of the projectile.

According to yet another aspect of the invention, a projectile includes: a fuselage have an outer surface; fins hingedly coupled to the outer surface of the fuselage; and fillers in spaces between the fins and the outer surface when the fins are in a compact configuration, close to the outer surface.

According to still another aspect of the invention, a method of projectile launching includes the steps of: providing an initial configuration of a projectile and a launcher, wherein the providing includes: providing the projectile with a fuselage having an outer surface, and fins hingedly coupled to the outer surface of the fuselage, providing the fins in a compact configuration with the fins close to the outer surface, providing filler material in spaces between the fins and the outer surface of the fuselage, and having the projectile located within the launcher; launching the projectile from the launcher; deploying the fins from the compact configuration to a deployed configuration; and separating the filler material from between the fins and the fuselage outer surface.

According to a further aspect of the invention, a method of configuring a projectile includes: providing the projectile with a fuselage and fins outside the fuselage and hingedly coupled to the fuselage, with the fins configured folded in toward the fuselage in a compact configuration; placing molds around spaces between the fins and an outer surface of the fuselage; and forming filler material blocks in the spaces. The forming includes: injecting a polymer material into the spaces; hardening the polymer material; and removing the molds.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

A projectile has filler material placed between an outer surface of its fuselage, and fins that are hingedly coupled to the fuselage. The filler material fills space that otherwise would be occupied by pressurized gases. Such pressurized gases could cause undesired outward force against the projectile fins during launch of the projectile from a launch tube or gun, such as when pressure outside the fins is suddenly removed, as in when the projectile passes a muzzle brake in the launch tube. Such outward pressure forces may cause bending or breakage of the fins, and may cause the fins to contact walls of the launch tube, possibly resulting in damage to the fins. The filler material may be any of a variety of lightweight solid materials, such as suitable plastics or closed cell foams. The filler material prevents pressurized gases from entering at least some of the space between the fins and the outer fuselage surface. When the fins deploy after the projectile emerges from the launch tube the filler material pieces fall away harmlessly. The projectile continues on its flight with the fins in the deployed configuration.

Figure 1:
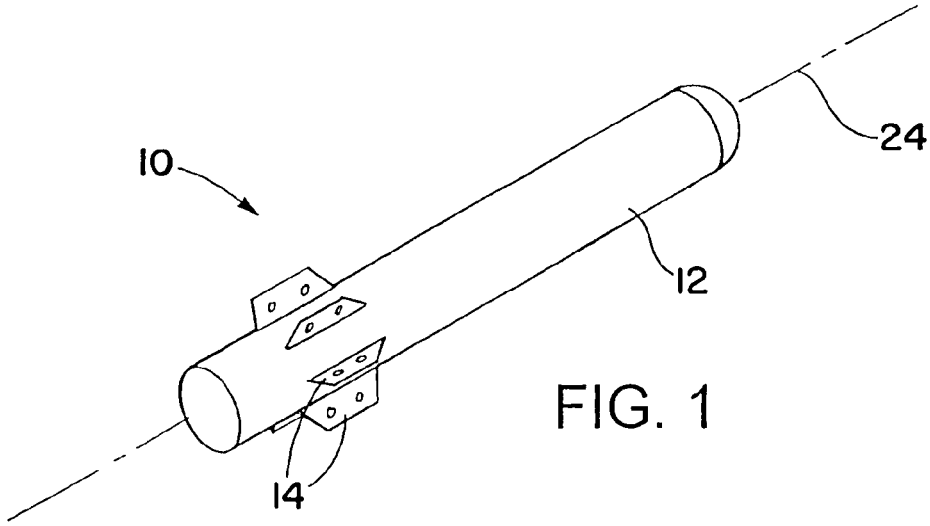
FIG. 1 is an oblique view of a projectile in accordance with an embodiment of the invention.
Figure 2:
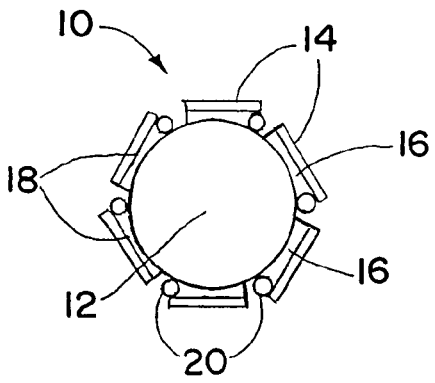
FIG. 2 is an end view of the projectile of FIG. 1, with fins of the projectile in a compact configuration.
Figure 3:
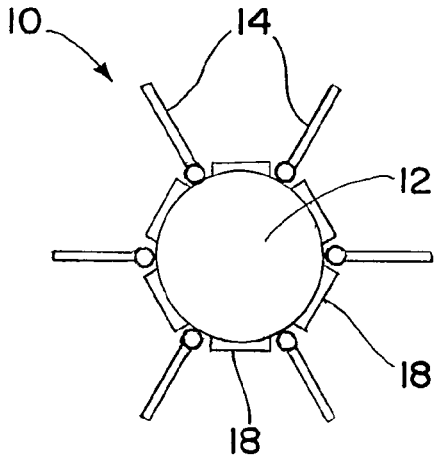
FIG. 3 is an end view of the projectile of FIG. 1 with the fins in a deployed configuration.

Referring initially to FIGS. 1-3, a projectile 10 has a fuselage 12 and a series of fins 14 that are hingedly coupled to the fuselage 12. The fins 14 may be in a compact configuration, shown in FIG. 2, in which the fins 14 are folded up against the fuselage 12, with spaces 16 between the fins 14 and a local outer surface of the fuselage 12. Filler material slabs or blocks 18 fill all or part of the spaces 16. The compact configuration shown in FIG. 2 allows the projectile 10 to fit into a launch tube or gun having a circular cross section. In the compact configuration the fins 14 may be substantially parallel to a tangent of the outer surface of the fuselage 12. The outer surface is a smooth surface that is exposed to the airstream around the projectile 10 during flight of the projectile 10. The outer surface is a surface on the aft portion of the fuselage 12 that may have any of a variety of suitable shapes. The outer surface may be substantially cylindrical, or may have any of a variety of other streamlined or drag-reducing shapes, including simple truncated cones or curved diameter reductions. In addition, it will be appreciated that the fuselage 12 may include provisions for fin attachments or propulsion systems, which may introduce special features in addition to the major structure shape. Upon exiting the launch tube or gun the fins 14 extend to the deployed or flight configuration shown in FIG. 3. In the deployed configuration the fins 14 may be substantially normal to the local outer surface of the fuselage 12.

The fins 14 may be made of steel, or another suitable material. The fuselage 12 and other components in the fuselage 12 may be similar to those of prior projectile designs.

Figure 4:
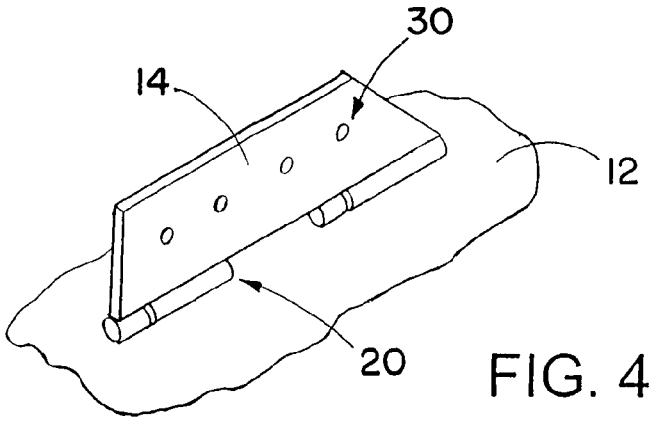
FIG. 4 is a detailed view of part of the projectile of FIG. 1.

With reference now in addition to FIG. 4, the fins 14 are coupled to the fuselage 12 at a series of hinges 20. The hinges 20 may be substantially parallel to an axis 24 of the projectile 10, allowing the fins 14 to rotate from generally parallel to the fuselage 12 (the compact configuration) to generally perpendicular to the fuselage 12 (the deployed configuration). This rotation is about hinge axes that may be substantially parallel to the projectile axis 24. (Or if a boattail shape is used, the rotation may be parallel to the local plane.) The hinges 20 may have a mechanism, for example a spring, that provides force to extend the fins 14 from the compact configuration to the deployed configuration. Alternatively the fins 14 may be deployed as result of forces on them during flight of the projectile 10. For example spinning of the projectile 10 about its axis 24 may deploy the fins 14 by centrifugal forces.

The hinges 20 may have locks that secure the fins 14 in the deployed positions. The locks may be any of a variety of mechanisms, for example involving one or more pins that engage suitable holes or recesses when the fins 14 reach the deployed positions.

Figure 5:
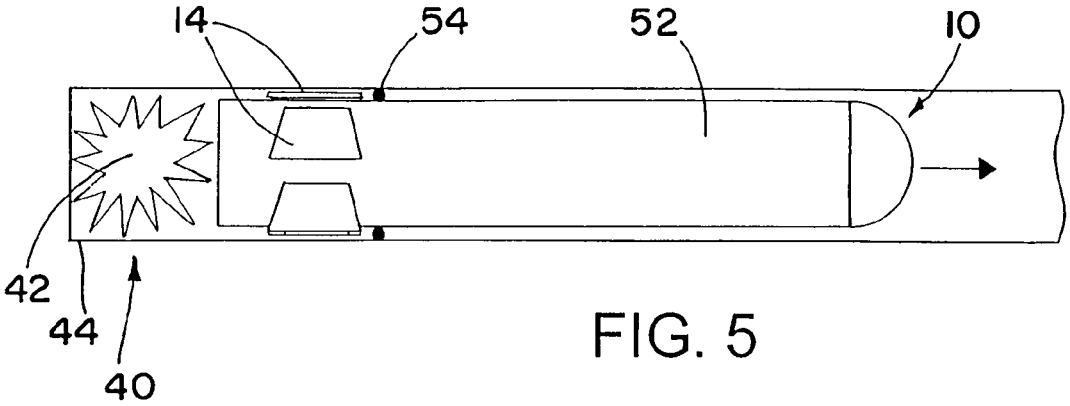
FIG. 5 is a cutaway view of a first step in the launch of the projectile of FIG. 1.

The filler material slabs or blocks 18 solve a problem that occurs during launch of the projectile 10, where the fins 14 receive a sudden pressure difference across them. FIG. 5 illustrates the beginning of a launch process for launching the projectile 10 from a launch tube or gun 40. A propelling charge 42 at a closed end 44 of the launch tube or gun 40 ignites, producing pressurized gases that propel the projectile 10 away from the closed end 44, in the direction of an open end of the launch tube 40. The propelling charge may be separate from the projectile 10, or may be attached to the projectile 10. At this phase or step in the launch process, the pressure is near isobaric under and over the fins 14.

Figure 6:
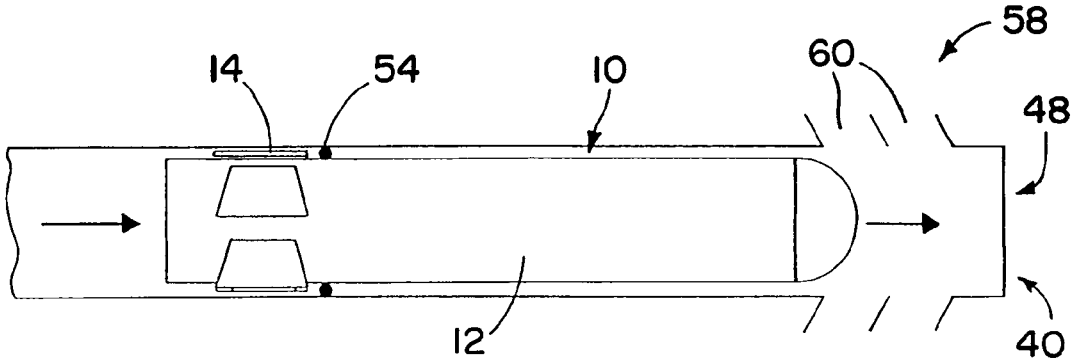
FIG. 6 is a cutaway view of a second step in the launch of the projectile.

FIG. 6 shows a later time in the launch process, with the projectile 10 approaching an open end 48 of the launch tube 40. The projectile 10 has an obturator 54 forward of the fins 14. The obturator 54 is a ring of a relatively soft material, such as copper or plastic, that forms a seal against the wall of the launch tube 40. This keeps pressurized gases behind the projectile 10, providing more force on the projectile 10. Use of an obturator can result in a 10% increase in exit velocity of a missile or other projectile.

A muzzle brake 58 is near the open end 48 of the launch tube 40. The muzzle brake 58 is a series of openings 60 used to redirect some of the pressurized gasses outward and backwards. This reduces the recoil from the launch of the missile or other projectile 10. At this phase or step in the launch, the inner and outer pressures on the surfaces of the fins 14 are still near isobaric.

Figure 7:
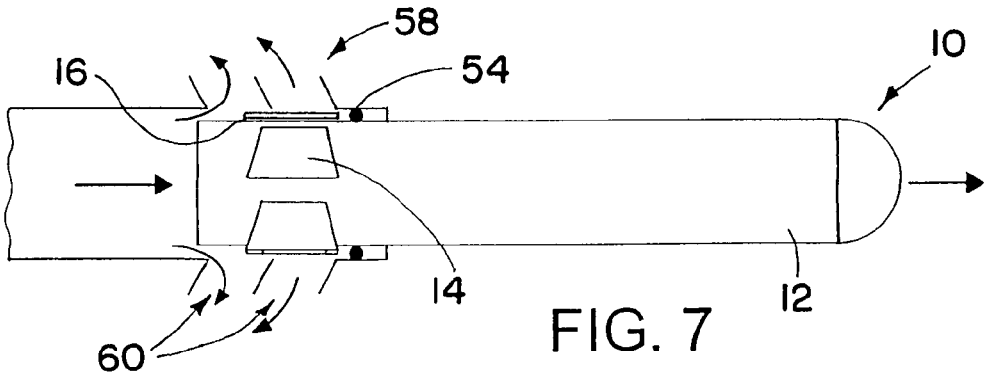
FIG. 7 is a cutaway view of a third step in the launch process.

Referring now to FIG. 7, once the obturator 54 passes the muzzle brake 58 pressurized gasses flow out from the launch tube 40 through the openings 60. This reduces the pressure outside of the projectile 10. If the filler material 18 were not present, some pressurized gas would be trapped as captive gas in the spaces 16 between fins 14 and the fuselage 12. Although the trapping of pressurized gases in the spaces 16 would be only temporary, it would have the potential to cause serious undesirable effects. Trapped pressurized gases may lead to a significant pressure difference across the faces (major surfaces) of the fins 14 (in the absence of the filler material blocks 18). To give example figures, the pressure difference may be from 13.8 MPa (2000 psi) to 68.9 MPa (10,000 psi) or even 82.7 MPa (12,000 psi). Such pressure differences exert considerable forces on the fins 14. For example a fin having dimensions of 15.2 cm (6 inches) by 12.7 cm (5 inches) has an area of 193 $cm^2$ (300 $in^2$). At a pressure difference of 68.9 MPa this results in a force of 1.33 MN (300,000 pounds).

Such a force could bend the fin 14 outward or cause the fin 14 to push outward, pivoting on the hinge 20. This may bring the tip of the fin 14 into contact with the wall of the launch tube 40. A particular hazard is contact between the fin 14 and the edges of the launch tube 40 surrounding the openings 60 of the muzzle brake 58. The mechanical stresses on the fins 14 may cause other problems, such as mechanical failure (breakage) of parts of the fins 14. The result may be damaged fins 14 that perform their function inadequately if at all. Damage to the fins 14 may cause complete loss of the projectile 10. In addition, damage to the launch tube or gun 40 may result.

The filler material 18 provides a solution to the problem of trapped pressurized gases in the spaces 16. By filling some or all of the volume of the spaces 16, the filler material 18 at least greatly ameliorates the effect of a pressure difference on the fins 14 caused by captive or trapped gases. The filler material 18 eliminates the push of high pressure gas against the inner faces of the fins 14 by have filler material 18 in contact with the fin inner faces and relevant parts of surfaces of the projectile fuselages 12. In addition, a smaller volume of trapped gas means that the pressure in the gas is more easily relieved. The gas pressure may be relieved by movement around the edges of the fins 14, from the high pressure fin face to the region around the low pressure fin face. Also any deformation of the fins 14 will itself reduce the pressure by increasing the volume being filled by pressurized gases. If some of the space 16 is filled by the filler material 18, the increase in volume underneath the fins caused by deformation of the fins 14 will itself result in more of a reduction in pressure. An as example, it will be appreciated that the ideal gas law, $PV=nRT$, where P is pressure, V is volume, T is temperature, n is the number of moles of gas, and R is a universal gas constant, indicates the energy in the system. If the free volume is reduced from 74 ml (4.5 $in^3$) to 0.74 ml (0.045 $in^3$) the total system energy is likewise reduced by a factor of 1000. The remaining 0.74 ml (0.045 $in^3$) produce no significant pressure effect on the fins 14.

Figure 8:
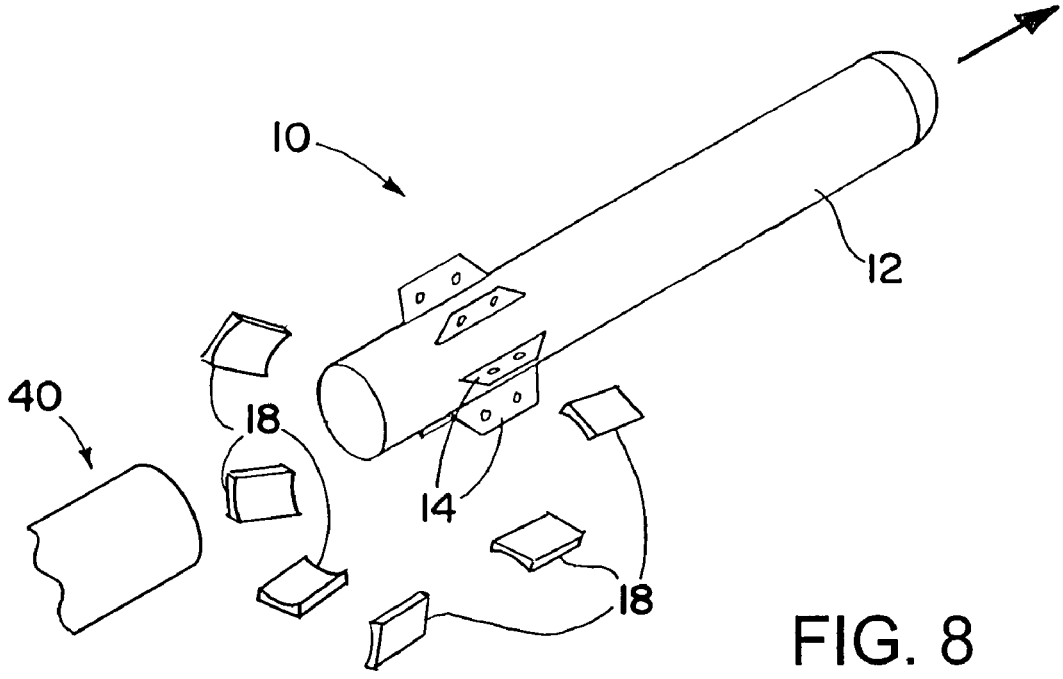
FIG. 8 shows a view of a fourth step in the launch process.

As shown in FIG. 8, the filler material 18 may separate from the projectile 10 when the projectile 10 emerges from the launch tube 40. The filler material 18 may fall away from the fins 14 as the fins 14 deploy from the compact configuration to the deployed configuration. Even if the filler material slabs or blocks 18 may be initially adhered to the fins 14 and/or the outer surface of the fuselage 12, forces on the filler material slabs or blocks 18 caused by placing them in the airstream of the flying projectile 10 may be sufficient to dislodge the filler material slabs or blocks 18. The separated filler material slabs or blocks 18, being made of lightweight material, may fall away from the projectile 10 without being a serious threat to nearby personnel or equipment.

The filler material slabs or blocks 18 may be made of any of a variety of suitable materials. It is desirable for the filler material to be light weight, so as to decrease the mass that needs to be accelerated by the propelling charge 42, so as to present less of hazard when separated from the other parts of the projectile 10. The filler material 18 may be a suitable plastic, such as nylon. The filler material 18 alternatively or in addition may be a foam material, such as a closed-cell foam with a plastic (polymer) material continuous phase. It will be appreciated that other alternatives are possible, such as plastic blocks with hollow interiors.

As an example, a typical block would be the size of chord and span of the surface to be protected, with a depth the difference between the outside diameter of the body and the stowed diameter of the inner surface side. To give one example, a block might be about 7.1 cm (2.8 inches) in width by 20.3 cm (8 inches) long by 0.5 cm (0.2 inches), for a total volume of 74 ml (4.5 $in^3$), weighing about 82 grams (0.18 lbs). In this example there would be 6 blocks for a combined weight of 0.49 kg (1.08 lbs). It will be appreciated that this is only a single example, and that a wide variety of sizes, shapes, number, and weight of blocks 18 may be employed.

Figure 9:
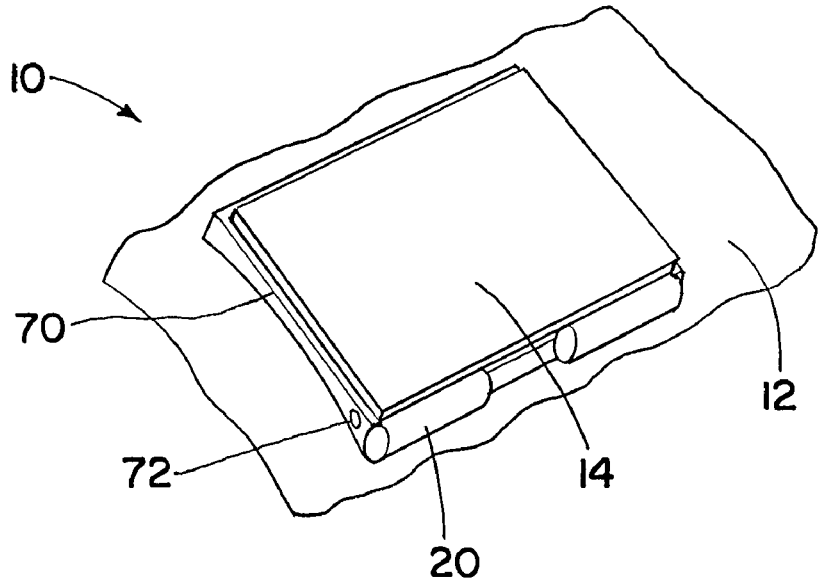
FIG. 9 is an oblique view of part of the projectile of FIG. 1, illustrating a process of using a mold to form a filler material block or slab.

The filler material slabs or blocks 18 may be formed first, and then placed in the spaces 16 between the fins 14 and the fuselage 12. Alternatively, and as shown in FIG. 9, the filler material slabs or blocks 18 may be formed in place, by placing a mold 70 around each of the spaces 16 between the fins 14 and the outer surface of the fuselage 12. Then liquid material or foam is introduced into the spaces 16, such as being injected through an opening 72 in the mold 70. The liquid material or foam is allowed to fill the spaces 16, being constrained by the molds 70, the fins 14, and the fuselage 12. It will be appreciated that foam materials may easily expand when injected into the space 16, filling substantially all of the spaces 16. Once the filler material has hardened the molds 70 may be removed, leaving filler material slabs or blocks 18 in place between the fins 14 and the fuselage 12.

The filler material slabs or blocks 18 may fill substantially all of the volume of the spaces 16. Alternatively the filler material may fill something less than 100% of the volume of the spaces 16, for example filling at least 90% of the volume of the spaces 16. It will be appreciated that the percentage required would depend on the strength of the fin material, the over pressure to be managed, and any constraints of how quickly the fin is permitted to open. The filler material slabs or blocks 18 may be in contact with and may be attached to either or both of the fins 14 and the fuselage 12. The filler material 18 need not be in contact with both the fins 14 and the fuselage 12, and may for example be attached to one or the other without being in contact with the other.

The use of the filler material 18 may be combined with other measures to reduce the effect of trapped pressurized gas on the fins 14. For example spiracles (holes or other openings that allow passage of pressurized gases) may be provided in the fins 14. A concurrently-filed application, "Projectile Having Fins With Spiracles," Ser. No. 12/257,690,which is incorporated herein in its entirety, describes many possible configurations for spiracles in fins, with or without flaps or other covering structures.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A projectile comprising:

a fuselage having an outer surface;

fins hingedly coupled to the outer surface of the fuselage; and fillers in spaces between the fins and the outer surface when the fins are in a compact configuration, close to the outer surface.

2. The projectile of claim 1, wherein the fillers fill at least 90% of the volume of the spaces between the fins and the outer surface of the fuselage, when the fins are in the compact configuration.

3. The projectile of claim 1, wherein the fillers fill substantially all of the volume of the spaces between the fins and the outer surface of the fuselage, when the fins are in the compact configuration.

4. The projectile of claim 1, wherein the fillers include polymer material.

5. The projectile of claim 1, wherein the fillers include closed foam.

6. The projectile of claim 1, wherein the fillers are not adhered to either the fuselage or the fins.

7. The projectile of claim 1, wherein the fillers are adhered to at least one of the fuselage or the fins.

8. The projectile of claim 1, wherein the fillers are molded into place in contact with the fins and the fuselage.

9. The projectile of claim 1, wherein the fins are substantially parallel to a tangent of the outer surface when the fins are in the compact configuration.

10. The projectile of claim 1, wherein the fins may be moved from the compact configuration to a deployed configuration.

11. The projectile of claim 10, wherein the fins are substantially perpendicular to the outer surface when the fins are in the deployed configuration.

12. The projectile of claim 1, wherein the outer surface is an external surface of the fuselage that is exposed to an airstream during flight of the projectile.

13. The projectile of claim 1, wherein the outer surface is a substantially cylindrical outer surface.

14. The projectile of claim 13, wherein the fins may be moved from the compact configuration to a deployed configuration; and wherein substantially all of the fins are radially outboard of the substantially cylindrical outer surface of the fuselage, in both the compact configuration and the deployed configuration.

15. A method of projectile launching, the method comprising:

providing an initial configuration of a projectile and a launcher, wherein the providing includes:

providing the projectile with a fuselage having an outer surface; and fins hingedly coupled to the outer surface of the fuselage;

providing the fins in a compact configuration with the fins close to the outer surface;

providing filler material in spaces between the fins and the outer surface of the fuselage; and having the projectile located within the launcher;

launching the projectile from the launcher;

deploying the fins from the compact configuration to a deployed configuration; and separating the filler material from between the fins and the fuselage outer surface.

16. The method of claim 15, wherein the providing the filler material includes providing the filler material in at least 90% of the volume of the spaces between the fins and the outer surface of the fuselage, when the fins are in the compact configuration.

17. The method of claim 15, wherein the providing the filler material includes placing already-formed blocks of filler material in the spaces between the fins and the fuselage.

18. The method of claim 15, wherein the providing the filler material includes forming the filler material in placed by molding filler material blocks in using molds placed around the spaces between the fins and the fuselage.

19. The method of claim 18, wherein the molding includes introducing polymer foam into the spaces, and hardening the polymer foam while the polymer foam is in the spaces.

20. The method of claim 15, wherein the separating occurs after the projectile has emerged from the launcher.

21. The method of claim 20, wherein the separating occurs during the deploying of the fins.

22. The method of claim 15, wherein the outer surface is an external surface of the fuselage that is exposed to an airstream during flight of the projectile.

23. The method of claim 15, wherein the outer surface is a substantially cylindrical outer surface.

24. A method of configuring a projectile, the method comprising:

providing the projectile with a fuselage and fins outside the fuselage and hingedly coupled to the fuselage, with the fins configured folded in toward the fuselage in a compact configuration;

placing molds around spaces between the fins and an outer surface of the fuselage; and forming filler material blocks in the spaces, wherein the forming includes:

injecting a polymer material into the spaces;

hardening the polymer material; and removing the molds.

25. The method of claim 24, wherein the injecting the polymer material includes injecting a polymer material foam.

* * * * *